US009524591B2

(12) United States Patent
Coste

(10) Patent No.: US 9,524,591 B2
(45) Date of Patent: Dec. 20, 2016

(54) METHOD AND SYSTEM FOR THE TRACEABILITY OF A TOOL VIBRATORY CHARGE AND TOOL FOR USE WITH THE SYSTEM

(75) Inventor: Jean-Pierre Coste, Beaumont les Valence (FR)

(73) Assignee: SOCIETE DE PROSPECTION ET D'INVENTIONS TECHNIQUES SPIT, Bourg-les-Valence (FR)

( * ) Notice: Subject to any disclaimer, the term of this patent is extended or adjusted under 35 U.S.C. 154(b) by 822 days.

(21) Appl. No.: 12/672,303

(22) PCT Filed: Aug. 7, 2008

(86) PCT No.: PCT/IB2008/002084

§ 371 (c)(1),
(2), (4) Date: Feb. 5, 2010

(87) PCT Pub. No.: WO2009/019587

PCT Pub. Date: Feb. 12, 2009

(65) Prior Publication Data

US 2011/0162858 A1 Jul. 7, 2011

(30) Foreign Application Priority Data

Aug. 8, 2007 (FR) ..... 07 05771

(51) Int. Cl.
*B25D 17/11* (2006.01)
*B25D 17/24* (2006.01)
(Continued)

(52) U.S. Cl.
CPC .. *G07C 3/08* (2013.01); *B25F 5/00* (2013.01)

(58) Field of Classification Search
USPC ..... 173/1, 2, 20, 162.1, 171
See application file for complete search history.

(56) References Cited

U.S. PATENT DOCUMENTS 5,170,358 A * 12/1992 Delio ..... 700/177
5,736,970 A * 4/1998 Bozeman, Jr. ..... 345/35
(Continued)

FOREIGN PATENT DOCUMENTS

DE 10303005 A1 8/2004
FR 2850312 A1 7/2004
(Continued)

OTHER PUBLICATIONS

FR Search Report for FR 0705771 dated Mar. 4, 2008.
ISR and WO for PCT/IB2008/002084 mailed Dec. 30, 2008.

*Primary Examiner* — Gloria R Weeks
*Assistant Examiner* — Eyamindae Jallow
(74) *Attorney, Agent, or Firm* — Hauptman Ham, LLP

(57) ABSTRACT

The system is intended to block the tool operation for an operator holding a badge the authorized working time of which is over. The system comprises: the operator badge, comprising a storage memory for the working time carried out by the operator and a communication unit; the tool, comprising an accelerometric sensor and a housing for control and vibratory traceability comprising a communication module, arranged to exchange data with the operator badge and means for blocking the tool operation. For the vibratory charge traceability of the tool, in the tool, the accelerations experienced by the tool while operating and its corresponding working times, forming traceability data, are measured; the traceability data in the tool are saved; the traceability data are transmitted to an operator personal badge.

16 Claims, 1 Drawing Sheet

(51) Int. Cl.
*G07C 3/08* (2006.01)
*B25F 5/00* (2006.01)

(56) References Cited

U.S. PATENT DOCUMENTS

| | | | | | |
|---|---|---|---|---|---|
| 6,004,017 | A | * | 12/1999 | Madhavan | 700/71 |
| 6,241,435 | B1 | * | 6/2001 | Huang et al. | 409/141 |
| 6,374,195 | B1 | * | 4/2002 | Li et al. | 702/182 |
| 6,390,205 | B2 | * | 5/2002 | Wallgren et al. | 173/2 |
| 7,036,703 | B2 | | 5/2006 | Grazioli et al. | |
| 7,578,193 | B2 | * | 8/2009 | Davidson | 73/661 |
| 2003/0037423 | A1 | * | 2/2003 | Siegel | 29/407.01 |
| 2004/0102880 | A1 | * | 5/2004 | Brown | 701/29 |
| 2009/0114411 | A1 | * | 5/2009 | Paprocki | 173/176 |
| 2010/0018494 | A1 | * | 1/2010 | Obermeier et al. | 123/198 R |
| 2010/0126027 | A1 | * | 5/2010 | Oberheim | 30/392 |

FOREIGN PATENT DOCUMENTS

| | | | | |
|---|---|---|---|---|
| GB | 2418252 | A | * | 3/2006 |
| GB | 2420623 | A | * | 5/2006 |
| GB | 2435001 | A | | 8/2007 |
| GB | 2420623 | A | | 2/2010 |

* cited by examiner

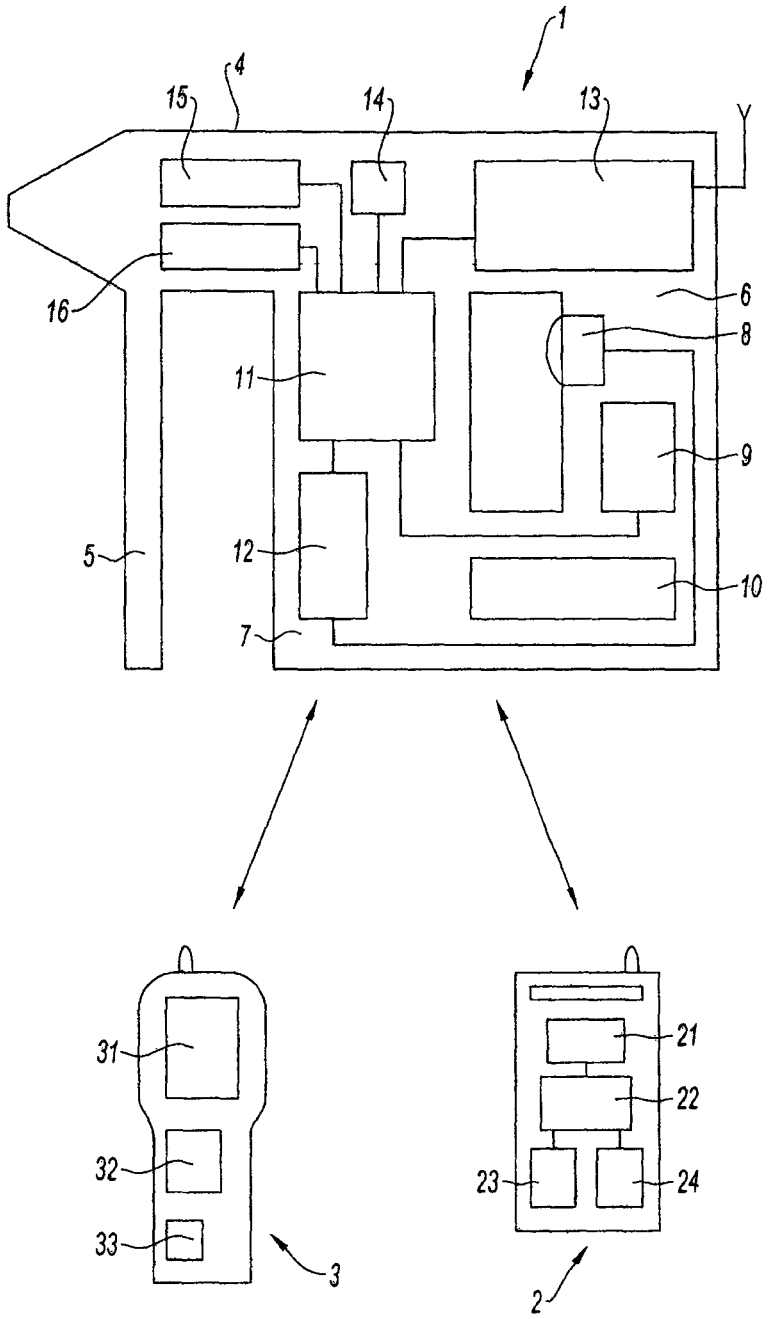
1
4
15
14
13
Y
16
6
8
11
9
5
12
10
7
31
32
33
3
21
22
23
24
2

METHOD AND SYSTEM FOR THE TRACEABILITY OF A TOOL VIBRATORY CHARGE AND TOOL FOR USE WITH THE SYSTEM

RELATED APPLICATIONS

The present application is national phase of PCT/IB2008/002084 filed Aug. 7, 2008, and claims priority from French Application Number 07 05771 filed Aug. 8, 2007, the disclosures of which are hereby incorporated by reference herein in their entirety.

The invention relates to tools that are used in building and civil engineering sites among others, such as screwing machines, drills, and other sealing tools operated with electrical power (mains or battery operated), gas (gas cartridge) or powder (propelling charges).

While operating, these tools are all submitted to vibration movements.

The builders have always tried to make them vibrate as little as possible and will be obliged to increase their efforts in that respect when the European guidelines come into force.

The vibrations of a tool are expressed by its own acceleration, an acceleration of 2.5 $ms^{-2}$ for a screwing machine being perfectly tolerable.

For a tool the vibrations of which are expressed by an acceleration between 2.5 and 5 $ms^{-2}$, the regulatory prescriptions imply that it should be assured that the operator will not use it more than 8 hours continuously.

This comes from the health hazards, including in terms of circulation.

The Applicant has been looking for a solution to this problem of time of use by an operator of a vibrationally driven tool while operating, i.e. the problem of traceability for vibratory charge by operator, and proposes consequently their invention.

The present application relates first to a traceability process for the vibratory charge of a vibrationally driven tool while operating, comprising the steps of

- measuring in the tool the accelerations experienced by the tool while operating and the corresponding working times thereof forming traceability data;
- saving the traceability data in the tool; and
- transmitting the traceability data to an operator personal badge.

In a particular implementation of the process of the invention, the traceability data are transmitted upon request to a distant terminal, fixed or mobile, a cellular phone or a computer, portable or not.

Preferably, the working times are determined by vibratory ranges.

In the preferred implementation of the process,

- the tool operation is checked by an operator badge,
- after a data exchange between the tool and the badge,
- for the badge holder, a compensatory rest time is calculated in order to possibly block the tool operation in case of an authorized working time overflow.

Advantageously,

- the working time is counted from the actuation of the tool power driving control, and
- the traceability data are saved when the power supply control has been stopped.

Preferably, the traceability data are transmitted to the operator badge when the tool power supply control has been stopped.

The application also relates to a system for vibratory traceability and control of a tool, intended to block its operation for at least one operator bearing a badge the authorized working time of which is over, comprising:

- the operator badge, comprising a storage memory for the working time carried out by the operator and a communication unit, possibly
- a tool power driving terminal comprising a communication unit and means for blocking the tool operation, and
- the tool comprising, besides power supply means and actuating means, an accelerometric sensor and a checking and vibration traceability housing comprising a communication module, arranged to exchange data with the operator badge and the driving terminal, and means for blocking the tool operation.

The present application also relates to the tool comprising the housing for vibratory traceability checking and accelerometric sensor, as intermediate product for the vibratory traceability system of the invention.

The invention will be better understood with the help of the following description of the vibratory traceability system, with reference to the one accompanying figure which represents a block diagram for the system.

The vibratory traceability system that will now be described relates to a tool, here a drill 1, which can be used by various operators each holding an operator badge 2, and to a driving terminal 3.

The tool 1 comprises a receiving housing 4 which is integral with a gripping handle 5 and an actuating handle 6. Also integral with the tool housing, there is a housing for checking and vibratory traceability 7. The tool comprises here, within the actuating handle 6, a manual actuator 8 for starting the tool, and an accelerometric sensor 9, a three axe accelerometer 0-25 g (g being the gravity constant). Are also provided energy supply means for the tool, here a battery 10.

All the elements and components that will now be described are part of the checking housing 7, even if, on the drawing, the belonging to this housing has not been well respected or well illustrated.

The checking housing 7 comprises here, as a central unit, a microcontroller 11, connected by a bus to a driving control module 12, a wireless communication module 13, a memory 14, a clock 15 and an alarm unit 16.

The microcontroller 11 is a managing and checking module which has to be considered here as means for blocking the operation of the tool. The communication module 13 is here a data transmitting card Bluetooth. The alarm unit 16 provides a sound and/or a visual alarm.

Through its wireless communication module 13, the tool may communicate with an operator badge 2.

The badge 2, here of a credit card type, but a strap badge is also equally envisioned, comprises a wireless communication unit (Bluetooth) 21, with its radio antenna, a microcontroller 22, a memory 23 and an energy source 24 of its own, all the components being connected to the microcontroller 22.

By its communication module 13, the tool can communicate with the driving terminal 3. Here, reference is made to a cellular phone also comprising a wireless communication unit (Bluetooth) 31 and, in cooperation with a microcontroller 32, a storage memory 33, here of a JAVA software for visualizing the vibratory traceability data. The microcontroller 32 has to be here considered as constituting, with the memory 33, the means for blocking the tool operation.

The operation of the system will be now described.

The accelerations of the tool upon the operation thereof are measured by the sensor 9 and distributed according to predetermined vibratory ranges.

Thanks to the clock 15, the working times corresponding to the different acceleration ranges are also determined by the microcontroller 11 and, when the tool operation is stopped, the working times are stored into the memory 14 and instantaneously transmitted to the operator badge 2, in the memory 23 thereof.

The tool 1 can only operate with a badge 2.

When an operator wants to use it, it communicates the Bluetooth, the tool and its badge. The tool recovers the operator working times and the microcontroller 11 calculates the compensatory rest time relating to the operator. If the authorized working time is not over, the microcontroller lets the manual actuator 8 control the control and driving module 12 so that it starts the tool. Otherwise, the microcontroller 11 blocks the tool operation. The operator is warned by the alarm of the unit 16 before passing over the authorized working time.

The memory 14 of the checking housing 7 for the tool 1 can be remotely read by the terminal 3, upon its request, to manage and check the memory data.

This system characteristic is interesting in the case of a set of tools for an engineering site, for managing the set by the site manager.

The invention claimed is:

1. A method of tracing vibration exposure of an operator of a tool that generates vibrations while operating, said method comprising:

measuring, in the tool, accelerations generated by the tool while operating and working times, which correspond to the accelerations, and forming traceability data;

saving the traceability data in the tool;

transmitting the traceability data to a badge carried by the operator and detached from the tool;

recovering the working times from the badge and related to the operator; and then calculating a compensatory rest time related to the operator (i) to block the operation of the tool when an authorized working time overflows and (ii) to permit the operation of the tool when the authorized working time does not overflow, wherein the tool is only operable with the badge.

2. The method according to claim 1, wherein the working times are measured in accordance with predetermined acceleration ranges.

3. The method according to claim 1, wherein the working time is measured from the actuation of the tool power driving control.

4. The method according to claim 1, wherein the traceability data are saved in the tool when a power supply control of the tool has been stopped.

5. The method according to claim 1, wherein the traceability data are transmitted to the operator's badge when a power supply control for the tool has been stopped.

6. The method according to claim 1, further comprising warning the operator before the authorized working time overflows.

7. The method according to claim 1, wherein said permitting the operation of the tool when the authorized working time does not overflow is performed after the compensatory rest time is over.

8. The method according to claim 1, further comprising, after said calculating, transmitting the traceability data upon request to a remote terminal which is separated from the badge and the tool, and the remote terminal blocks the operation of the tool when the authorized working time overflows.

9. The method according to claim 8, wherein the working times are measured in accordance with predetermined acceleration ranges.

10. The method according to claim 8, wherein the working time is measured from the actuation of the tool power driving control.

11. The method according to claim 8, wherein the traceability data are saved in the tool when a power supply control of the tool has been stopped.

12. The method according to claim 8, wherein the traceability data are transmitted to the operator's badge when a power supply control for the tool has been stopped.

13. A system for tracing vibration exposure of an operator of a tool that generates vibrations while operating, said system comprising:

a badge to be carried by the operator said badge including (i) a storage memory for storing working times carried out by the operator and (ii) a first communication unit, the tool unattached to the badge and having a housing that includes therein an energy supply, an actuator, an accelerometric sensor, a second communication unit, arranged to communicate with the first communication unit for data exchange with the badge, a controller for recovering the working times from the badge and related to the operator via the first and second communication units, and then calculating a compensatory rest time related to the operator (i) to block operation of the tool when an authorized working time overflows and (ii) to permit the operation of the tool when the authorized working time does not overflow, and a remote terminal which is separated from the badge and the tool and which includes (i) a third communication unit for communication and data exchange with the second communication unit of the tool, and (ii) a further controller configured to block the operation of the tool when the authorized working time overflows.

14. The system according to claim 13, wherein said housing further includes an alarm unit configured to warn the operator before the authorized working time overflows.

15. The system according to claim 13, wherein the tool is only operable with the badge.

16. The system according to claim 15, wherein said housing further includes an alarm unit configured to warn the operator before the authorized working time overflows.

* * * * *